US009194124B2

(12) United States Patent
Johnson et al.

(10) Patent No.: US 9,194,124 B2
(45) Date of Patent: Nov. 24, 2015

(54) ACOUSTIC LIGHT PANEL

(75) Inventors: Raymond P. Johnson, Lake Elmo, MN (US); Michael A. Meis, Stillwater, MN (US); Anthony J. Piekarczyk, Fridley, MN (US); Martin Kristoffersen, Porsgunn (NO); Stephanie B. Castiglione, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 400 days.

(21) Appl. No.: 13/315,316

(22) Filed: Dec. 9, 2011

(65) Prior Publication Data

US 2013/0148357 A1 Jun. 13, 2013

(51) Int. Cl.

| | |
|---|---|
| ***F21V 33/00*** | (2006.01) |
| ***E04B 9/32*** | (2006.01) |
| *F21Y 101/02* | (2006.01) |
| *E04B 1/84* | (2006.01) |

(52) U.S. Cl.

CPC ..... *E04B 9/32* (2013.01); *F21V 33/006* (2013.01); *E04B 2001/8433* (2013.01); *F21Y 2101/02* (2013.01)

(58) Field of Classification Search

CPC ..... F21Y 2102/02; F21V 33/006; E04B 9/32; E04B 2001/8433

USPC ..... 362/253, 96, 257, 147, 150, 148

See application file for complete search history.

(56) References Cited

U.S. PATENT DOCUMENTS

| | | | | |
|---|---|---|---|---|
| 2,715,449 | A | 8/1955 | Lemmerman | |
| 2,830,330 | A | 4/1958 | Heath | |
| 2,935,151 | A | 5/1960 | Watters | |
| 3,087,572 | A | 4/1963 | Baruch | |
| 3,253,675 | A * | 5/1966 | Baruch | 181/289 |
| 3,460,299 | A | 8/1969 | Wilson | |
| 5,638,151 | A * | 6/1997 | Berardi | 352/3 |
| 5,782,551 | A | 7/1998 | Capaul | |
| 6,367,581 | B1 * | 4/2002 | Marler et al. | 181/295 |
| 6,601,673 | B2 | 8/2003 | Murakami | |
| 6,617,002 | B2 | 9/2003 | Wood | |
| 6,767,609 | B2 | 7/2004 | Aeling | |
| 6,769,512 | B2 | 8/2004 | Bargo | |
| 6,817,442 | B2 | 11/2004 | Sleet | |

(Continued)

FOREIGN PATENT DOCUMENTS

| | | |
|---|---|---|
| DE | 19608583 | 9/1996 |
| DE | 202010003644 U | 8/2010 |

(Continued)

OTHER PUBLICATIONS

Supplementary European Search Report; EP 12 85 5293; Jun. 30, 2015, 3 pages.

*Primary Examiner* — Anh Mai

*Assistant Examiner* — Jessica M Apenteng

(74) *Attorney, Agent, or Firm* — Daniel J. Iden

(57) ABSTRACT

A sound absorbing luminaire providing lighting for an interior space environment and managing the acoustics within the environment. The luminaire includes a frame holding an acoustic film and a lighting element, forming a resonant cavity between them. The acoustic film is used for absorbing sound within the resonant cavity, and the lighting element provides light from a light source, such as LEDs, through the acoustic film. An optical film can be mounted in the frame between the acoustic film and the lighting element for providing a desired distribution of light.

19 Claims, 3 Drawing Sheets

(56) References Cited

U.S. PATENT DOCUMENTS

| | | | | |
|---|---|---|---|---|
| 6,977,109 | B1 | 12/2005 | Wood | |
| 7,303,305 | B2 * | 12/2007 | Kennedy | 362/147 |
| 7,467,498 | B2 | 12/2008 | Fontaine | |
| 7,481,563 | B2 | 1/2009 | David | |
| 7,660,509 | B2 | 2/2010 | Bryan | |
| 7,731,878 | B2 | 6/2010 | Wood | |
| 7,757,810 | B2 | 7/2010 | Sparks | |
| 7,954,975 | B2 * | 6/2011 | Zhou | 362/147 |
| 2004/0020712 | A1 | 2/2004 | Bargo | |
| 2004/0023587 | A1 | 2/2004 | Bargo | |
| 2005/0186392 | A1 | 8/2005 | Fontaine | |
| 2005/0188633 | A1 | 9/2005 | Fontaine | |
| 2006/0194497 | A1 | 8/2006 | Bargo | |
| 2007/0000201 | A1 | 1/2007 | Kennedy | |
| 2008/0062688 | A1 | 3/2008 | Aeling | |
| 2009/0250291 | A1 | 10/2009 | Sparks | |
| 2009/0297767 | A1 | 12/2009 | Fontaine | |
| 2010/0165660 | A1 | 7/2010 | Weber | |
| 2011/0193105 | A1 | 8/2011 | Lerman | |

FOREIGN PATENT DOCUMENTS

| | | |
|---|---|---|
| EP | 2221528 | 8/2010 |
| EP | 2261553 | 12/2010 |
| GB | 2304131 | 3/1997 |
| JP | 3295105 | 12/1991 |
| JP | 6-79808 | 11/1994 |
| JP | 2005-155318 | 6/2005 |
| JP | 2006-299789 | 11/2006 |
| WO | WO 00-05707 | 2/2000 |
| WO | 01/20224 | 3/2001 |
| WO | WO 01-39969 | 6/2001 |
| WO | WO 01-92782 | 12/2001 |
| WO | WO 2004-072397 | 8/2004 |
| WO | WO 2011-094342 | 8/2011 |

* cited by examiner

ACOUSTIC LIGHT PANEL

BACKGROUND

Efficient lighting solutions for interior locations are desirable. In addition, controlling the acoustics within the interior locations can be important depending upon an intended use of the space. Accordingly, there is a need to offer solutions that can benefit both the lighting and acoustic environment of interior spaces.

SUMMARY

A sound absorbing luminaire, consistent with the present invention, includes a spacer supporting an acoustic film and a lighting element with a resonant cavity formed between them. The acoustic film is used to absorb sound. The lighting element provides light from a light source, such as LEDs, through the acoustic film. An optical film can be included between the acoustic film and the lighting element for providing desired distribution of light.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

Embodiments of the present invention include a sound absorbing luminaire having an acoustic film, a lighting element, and an air gap formed between them. The acoustic film is used for dampening sound, and the lighting element provides light from a light source such as light emitting diodes (LEDs) or organic light emitting diodes (OLEDs), or other light source such as cold-cathode fluorescent lamps (CCFLs). An optical film can be used between the acoustic film and the light source to provide desired distribution of light. The sound absorbing light can serve the dual purpose of providing lighting for an interior space environment and managing the acoustics within the environment.

Figure 1:
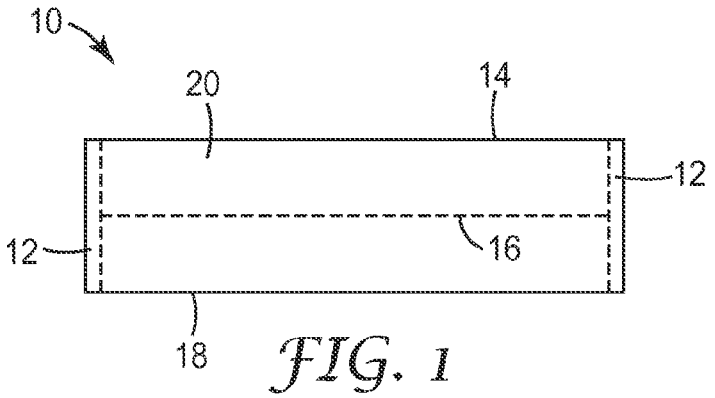
FIG. 1 is a side view of a first embodiment of an acoustic light panel.
Figure 2:
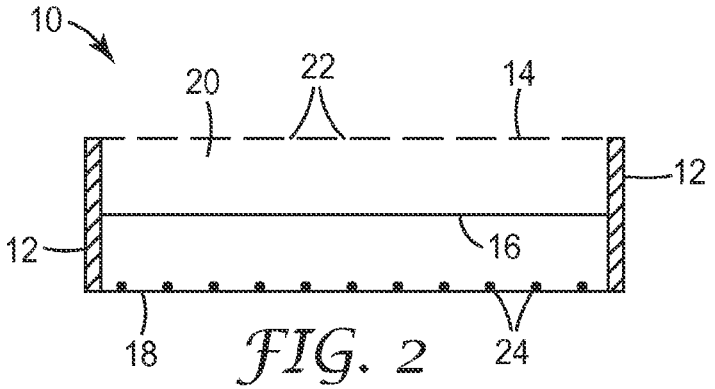
FIG. 2 is a side sectional view of the first embodiment.
Figure 3:
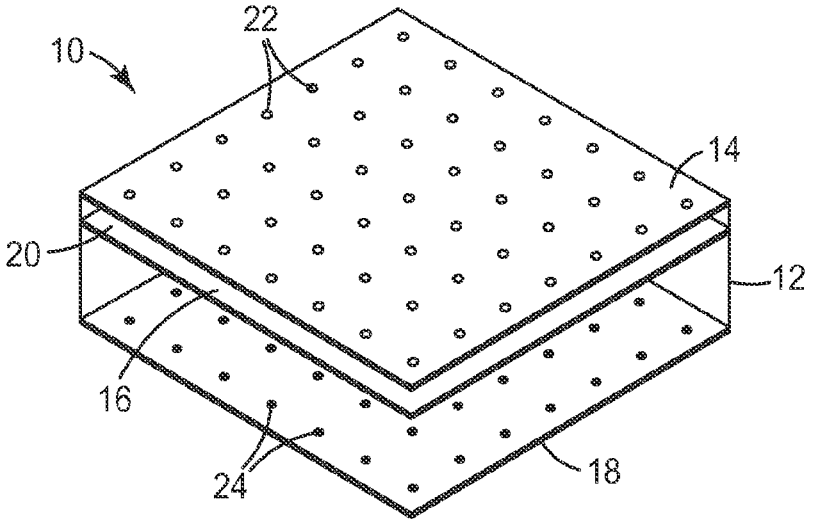
FIG. 3 is perspective sectional view of the first embodiment.

FIGS. 1-3 are side, side sectional, and perspective sectional views, respectively, of a first embodiment of an acoustic light panel 10. In this first embodiment, acoustic light panel 10 includes a spacer 12 supporting an acoustic film 14, an optical film 16, and a lighting element such as a light film 18. In FIG. 3, two portions of spacer 12 are removed to show the interior of acoustic light 10. Acoustic film 14 includes perforations 22 for use in dampening sound within a resonant cavity 20 formed between acoustic film 14 and optical film (or sheet) 16. Lighting element 18 includes a plurality of solid state light sources 24 such as LEDs, which would be connected to a power source for driving them. Solid state light sources 24 transmit light through acoustic film 14 with an air gap formed between acoustic film 14 and lighting element 18. Acoustic film 14 thus provides a light emitting surface for acoustic light panel 10, which can be used, for example, as a ceiling tile or wall tile to provide lighting with added acoustic control functionality.

Figure 4:
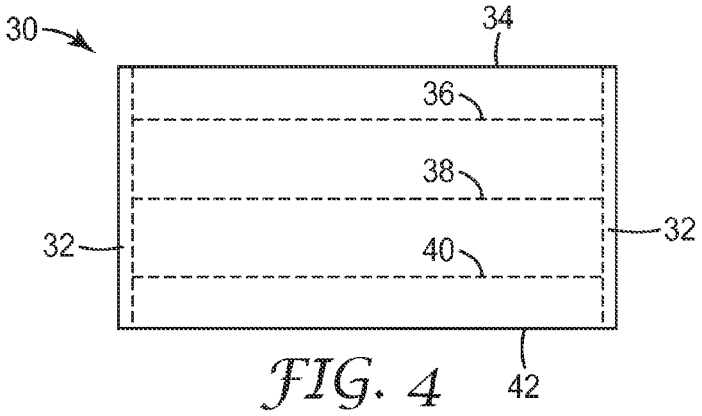
FIG. 4 is a side view of a second embodiment of an acoustic light panel.
Figure 5:
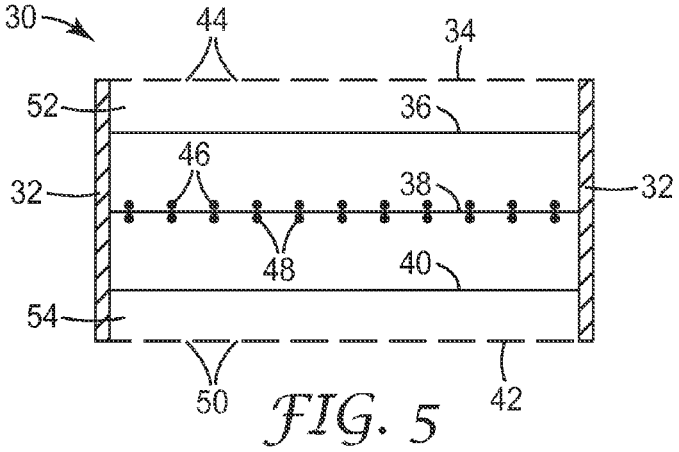
FIG. 5 is a side sectional view of the second embodiment.
Figure 6:
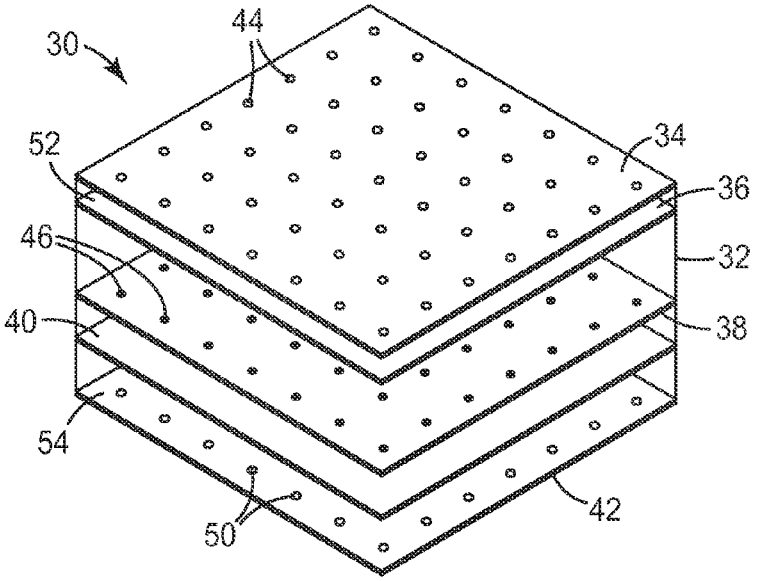
FIG. 6 is a perspective sectional view of the second embodiment.

FIGS. 4-6 are side, side sectional, and perspective sectional views, respectively, of a second embodiment of an acoustic luminaire 30. In this second embodiment, acoustic light panel 30 includes a spacer 32 supporting acoustic films 34 and 42, optical films 36 and 40, and a lighting element such as a doubled sided lighting element 38. In FIG. 6, two portions of spacer 32 are removed to show the interior of acoustic light 30. Acoustic films 34 and 42 include perforations 44 and 50, respectively, for use in dampening sound within a resonant cavity 52 formed between acoustic film 34 and optical film (or sheet) 36 and within a resonant cavity 54 formed between acoustic film 42 and optical film (or sheet) 40. Doubled sided lighting element 38 includes a first plurality of solid state light sources 46 on a first side of light film 38 and a second plurality of solid state light sources 48 on an opposite side of light film 38. Solid state light sources 46 and 48 can be implemented with LEDs, for example, which would be connected to a power source for driving them. Solid state light sources 46 and 48 transmit light through acoustic films 34 and 42, respectively, with light cavities formed between acoustic film 34 and double sided light film 38 and between acoustic film 42 and doubled sided light film 38. Acoustic films 34 and 42 thus provide dual and opposite light emitting surfaces for acoustic light panel 30, which can be used, for example, as a wall tile to provide lighting from the light emitting surfaces on both sides of the wall.

The optical film can be used to both create a resonant cavity for the acoustic film and provide desired distribution of light. The optical films need not be used and are optional components. If an optical film is not used, then the resonant cavity can be formed between the acoustic film and the lighting element. Furthermore, the lighting element can optionally function as both an optical element and light source, in which case a separate optical film is not necessarily needed.

The acoustic film and resonant cavity can be tuned for the sound dampening effect. For example, the size, number, and pitch of the holes in the acoustic film can be controlled, along with a depth of the resonant cavity. Aside from an air space or gap for the resonant cavity, a sound absorbing material can be included in the cavity. The acoustic film is translucent or clear to transmit light from the light sources and can, alternatively, include coloring, a graphic, or other printing on the light output surface. The graphic can be printed directly on the acoustic film and can be added internally or externally. The acoustic film can also optionally have a dry erase surface on its exterior side to provide an erasable and reusable writing surface, as illustrated in the Examples. When the acoustic luminaire is activated to provide light, the dry erase surface can function as a backlit dry erase board. Examples of preferred dry erase coatings to make a dry erase surface are described in PCT Application Publication No. WO 2011/094342, which is incorporated herein by reference as fully set forth, although any dry erase surface can be used with the acoustic luminaire.

In the embodiments described above, the acoustic luminaire is generally symmetrical from a side view but it need not be. As an alternative to a square or rectangular shape of the light emitting surface, the acoustic light can have other shapes on its light emitting surface such as a circular, oval, or an irregular shape. Also, as an alternative to a flat shape as shown, the luminaire can be curved as long as it maintains the correct spacing between the elements to provide for both lighting and the acoustic properties. For example, the luminaire can be implemented as a curved wall around a conversion node where the wall provides lighting and the acoustic property provides privacy. For either a flat or curved shape of the luminaire, the spacer can be implemented with a frame, for example, to hold the components in place with the correct spacing between them for the lighting and acoustic properties. The spacers or frames can also be used to tile together multiple acoustic luminaires for lighting, sound management, and possibly decorative purposes.

The lighting element for the acoustic light panels can use a direct lit light film or circuit, meaning the solid state light sources, such as LEDs, are located on a major surface of the film or circuit, or on both major surfaces for a double sided lighting element. As an alternative to a direct lit light film, the lighting elements can be implemented with an edge lit light guide. In an edge lit light guide, the solid state light sources, such as LEDs, are located at the edge of the light guide (hollow or solid), which distributes the light through one or both of its major surfaces. Also, the acoustic light panels can be configured to provide white light or, alternatively, can provide other colors for decorative lighting purposes. The solid state light sources can be connected to a control system to change or otherwise control the color output or light intensity.

The optical film in the luminaire can be implemented with a diffuser. Examples of diffusers include a diffuser film, a diffuser film on a plate, a diffuser plate, a beaded gain diffuser on a plate, a microreplicated diffuser on a plate, and a plate with any combination of diffusers and microreplicated films on either side. These diffusers can provide the desired amount of diffusion to make the luminaire provide more uniform light, and they may also provide additional benefits.

The acoustic light can optionally include other films or components. For example, it can include turning films to direct the light from the solid state light sources. Other optional films include brightness enhancement films, color filters, and spectrum enhancement films. When a frame is used to implement the spacer, the frame can include a light enhancement film, such as a reflective film, on its interior surface to enhance the light output.

The acoustic light can include a back layer on a side of the lighting element opposite the acoustic film. For example, the acoustic light can include a rear reflector as the back layer supported by the spacer. In other embodiments, the acoustic light can be configured for attachment of the spacer to a wall, ceiling, or other surface, in which case the surface to which the acoustic light is attached serves as the back layer.

The following are potential uses for the acoustic light, although other uses are possible. Alarm lighting and safety lighting can incorporate the acoustic light, for example under an automobile hood or within an automobile interior. Home and office environments can incorporate the acoustic light, for example under shelving lights, ceiling lights (replacing existing lights without sound management features), modular wall unit lights of varying depths (e.g., one to six inches), and task lighting. Buses and rail transportation can incorporate the acoustic light, for example safety lighting, alarm lighting, and cab interior lighting.

The Examples provide exemplary materials and components for implementing the acoustic light panels, although other types of materials and components can be used. The following references also provide examples of components for implementing the acoustic light panels, all of which are incorporated herein by reference as if fully set forth: U.S. Pat. No. 6,617,002 (acoustic film); U.S. Pat. Application Publication No. 2008/0062688 (light film); U.S. Pat. Application Publication No. 2010/0165660 (hollow edge lit light guide); and U.S. Pat. No. 7,660,509 (solid edge lit light guide).

EXAMPLES

An illuminated acoustic dampening ceiling tile prototype has been built using the following 3M Company films: microperforated acoustic dampening film, beaded gain optical films, Light Mat film, and light enhancement film. The frame for the tile was made from 0.9 cm (0.039 inch) aluminum sheet with dimensions of approximately 61 cm×58 cm×10 cm (24 inches×23 inches×4 inches). Four sheets of Light Mat film with 49 LEDs each were used as the light source for the prototype. The four sidewalls of the box were lined with light enhancement film. An optical plate consisting of one sheet of beaded gain optical film and one sheet of microreplicated gain optical film taped to a 1.5 mm thick acrylic plate was attached to a flange approximately 7.6 cm (3 inches) from the bottom of the box. The sound absorbing (acoustic) film was then attached to the front of the box, which created an approximately 2.5 cm (1 inch) deep resonant cavity between the optical plate and acoustic film. This resonant cavity is necessary for the acoustic dampening effect. The four sheets of Light Mat film were connected in series, and the drive current and voltage to the system was approximately I~1 A and V~13.6V, respectively.

The light output of the ceiling tile prototype was measured in a 2 meter integrating sphere for the LED drive given above. The first measurement was of the complete fixture. The films were then removed one at a time so that for the second measurement, the acoustic dampening film was removed. For the third measurement, the microreplicated gain diffuser (MGD) film was also removed. For the last measurement, the beaded gain diffuser (BGD) film and 1.5 mm acrylic plate were removed such that the measurement gave the output of the LEDs in the box only. Table 1 provides these measurements.

TABLE 1

Luminous flux and efficiency of lit ceiling tile for each component.

| | LEDs Only | LEDs + BGD | LEDs + BGD + MGD | LEDs + All Films |
|---|---|---|---|---|
| TLF (lm) | 799 | 725 | 647 | 615 |
| Eff. (%) | 100% | 91% | 81% | 77% |

Figure 7:
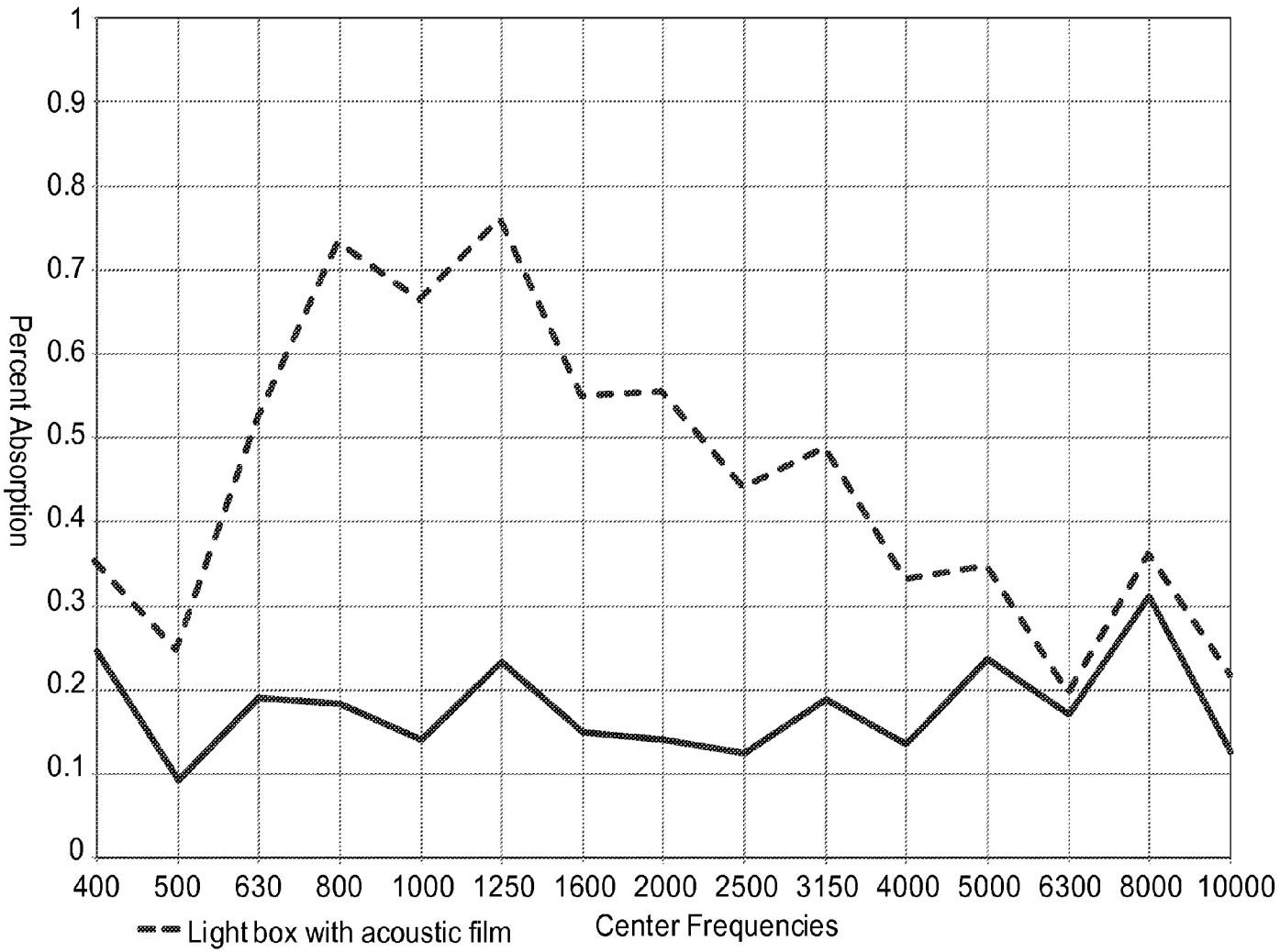
FIG. 7 is a graph of test results for the Examples showing sound absorption of a light box with and without an acoustic film.

The luminaire described above was tested for acoustic absorbance. The luminaire was tested with and without the acoustic film. The luminaire absorbed desired sound frequencies with the acoustic film. The luminaire did not absorb significant sound without the acoustic film in place. FIG. 7 is a graph of test results showing the sound absorption of the light box with and without the acoustic film.

A second example was fabricated in an effort to evaluate a thinner construction than that described above. For the example above, the distance from the Light Mat film source to the front face of the luminaire will, in part, determine the uniformity of the system. If the LED sources of the Light Mat film assembly are too close to the front surface, bright spots will appear indicating the location of the LED sources. With the Light Mat film at a greater distance, light from the LED sources will spread more and appear more uniform. Greater uniformity in a thinner design can also be achieved by increasing the diffusion of the intermediate film (the microreplicated gain diffuser film); however, increasing the system diffusion will also decrease system brightness and efficiency.

An alternative to placing the Light Mat film farther back from the face is to use an alternate geometry to increase the effective light path of light from the LEDs. In this alternate geometry, a new configuration of Light Mat film using a circuit substrate that can transmit light while still providing some diffusion can also eliminate the microreplicated gain diffuser film, or alternately, become the microreplicated gain diffuser film.

If the circuit for the Light Mat film were formed on the microreplicated gain diffuser film, for example on the back side of the film with LEDs facing the rear of the fixture, light from the LED sources would travel to the back of the fixture cavity where they would be reflected forward. If the rear reflector were a high efficiency diffuse reflector such as 3M 3635-100 Light Enhancement Film (3M Company), light from the sources would reflect forward diffusely, further spreading and mixing light from the sources. Upon passing through the intermediate film, whether a microreplicated gain diffuser or other non-transparent film, the light would spread further. In this configuration, the effective path length of light from the LED sources is significantly increased and has the added benefit of high efficiency diffuse reflection from the back of the fixture cavity, thus increasing uniformity without decreasing transmission of the diffuser. A similar construction of this kind of fixture is described in U.S. Pat. No. 7,481,563, but without the additional acoustic properties.

An example was fabricated in a 30.5 cm×30.5 cm (12 inch×12 inch) configuration. A box was formed from aluminum and lined with 3M 3635-100 Light Enhancement Film. The depth of the box was 2 cm (0.75 inches). A unique configuration of Light Mat film was fabricated on a beaded gain diffuser film (KEIWA Inc.) with circuits on the back (smooth) side of the film. LEDs were placed 5 cm (2 inches) apart in parallel rows with positions in adjacent rows staggered so LEDs in rows were 2.5 cm (1 inch) apart.

The diffuser Light Mat film was mounted to the top of the box with the LEDs facing into the box. A separate frame was fabricated to mount to the front of the box over the reverse Light Mat film. The frame was 1.3 cm (0.50 inches) deep. A thin acrylic panel was laminated with 3M 3635-70 white diffuser film (3M Company) that is approximately 70% transmissive. In this construction, fixture uniformity was greater than 90%. When the acoustic film was substituted, uniformity dropped considerably as the acoustic film is very transparent. However, when using an acoustic film with greater diffusion such a thin construction is possible.

Another example incorporated a dry erase surface into the acoustic light box. An acoustic light panel was fabricated using a STEELCASE steel cubicle frame (Steelcase Inc.) and was fitted with the following: a Gatorboard foam board center layer, a 3M Light Mat film adhesively applied to the foam board, acoustic THINSULATE material (3M Company) added on top of the Light Mat film, and an acoustic perforated film (3M Company) overlaid on each side of the panel frame. A 3M SCOTCHCAL Graphic (3M Company) was used to adhesively apply a 3M logo to one side of the panel. On the other side of the panel, a RUST-OLEUM two part dry erase paint (Rust-Oleum Corporation) was mixed and applied to a section of the acoustic perforated film, resulting in a dry erase surface.

The invention claimed is:

1. A sound absorbing luminaire, comprising:

an acoustically reflective and transmissive acoustic film, wherein the acoustic film comprises a perforated film having open perforations;

a lighting element providing light from a light source through the acoustic film;

a spacer supporting the acoustic film and the lighting element, the spacer creating an air gap between the acoustic film and the lighting element wherein a resonant cavity is formed within the air gap between the acoustic film and the lighting element; and an optical film between the acoustic film and the lighting element, wherein the resonant cavity is formed between the optical film and the acoustic film.

2. The luminaire of claim 1, further comprising a back layer supported by the spacer and located on a side of the lighting element opposite the acoustic film.

3. The luminaire of claim 1, wherein the spacer is configured for attachment to a back layer located on a side of the lighting element opposite the acoustic film.

4. The luminaire of claim 1, wherein the optical film comprises a diffuser.

5. The luminaire of claim 1, wherein the light source comprises LEDs.

6. The luminaire of claim 1, wherein the lighting element comprises a light film.

7. The luminaire of claim 1, wherein the lighting element comprises a hollow edge lit light guide.

8. The luminaire of claim 1, wherein the lighting element comprises a solid edge lit light guide.

9. The luminaire of claim 1, wherein the spacer comprises a frame for mounting the acoustic film and the lighting element, further comprising a light enhancement film on an interior surface of the frame.

10. The luminaire of claim 1, wherein the lighting element provides for diffusion of the light from the light source.

11. The luminaire of claim 1, wherein the acoustic film has a dry erase surface on a side of the acoustic film opposite the lighting element.

12. A sound absorbing luminaire, comprising:

a spacer;

a first acoustically reflective and transmissive acoustic film supported by the spacer, wherein the first acoustic film comprises a first perforated film having open perforations;

a second acoustically reflective and transmissive acoustic film supported by the spacer, opposite the first acoustic film, wherein the second acoustic film comprises a second perforated film having open perforations;

a double sided lighting element supported by the spacer, between the first and second acoustic films, and providing light from a light source through the first and second acoustic films, wherein the spacer creates an air gap between the first acoustic film and the lighting element and between the second acoustic film and the lighting element, wherein a first resonant cavity is formed between the first acoustic film and the double sided lighting element for at least partially absorbing the sound transmitted by the first acoustic film and a second resonant cavity is formed between the second acoustic film and the double sided lighting element for at least partially absorbing the sound transmitted by the second acoustic film;

a first optical film between the first acoustic film and the double sided lighting element, wherein the first resonant cavity is formed between the first optical film and the first acoustic film; and a second optical film between the second acoustic film and the double sided lighting element, wherein the second resonant cavity is formed between the second optical film and the second acoustic film.

13. The luminaire of claim 12, wherein the first and second optical films each comprise a diffuser.

14. The luminaire of claim 12, wherein the light source comprises LEDs.

15. The luminaire of claim 12, wherein the double sided lighting element comprises a double sided light film.

16. The luminaire of claim 12, wherein the double sided lighting element comprises a hollow edge lit light guide.

17. The luminaire of claim 12, wherein the double sided lighting element comprises a solid edge lit light guide.

18. The luminaire of claim 12, wherein the spacer comprises a frame for mounting the first and second acoustic films and the lighting element, further comprising a light enhancement film on an interior surface of the frame.

19. The luminaire of claim 12, wherein the lighting element provides for diffusion of the light from the light source.

* * * * *